US008643558B2

(12) United States Patent
Tseng et al.

(10) Patent No.: US 8,643,558 B2
(45) Date of Patent: Feb. 4, 2014

(54) MULTI-FREQUENCY ANTENNA

(75) Inventors: Hsien-Sheng Tseng, New Taipei (TW); Chun-Ming Chiu, New Taipei (TW); Wen-Fong Su, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 358 days.

(21) Appl. No.: 13/069,386

(22) Filed: Mar. 23, 2011

(65) Prior Publication Data

US 2011/0267246 A1 Nov. 3, 2011

(30) Foreign Application Priority Data

Apr. 28, 2010 (TW) ..... 99113420

(51) Int. Cl.
*H01Q 9/00* (2006.01)

(52) U.S. Cl.
USPC ..... 343/750; 343/749; 343/829; 343/830; 343/846

(58) Field of Classification Search
USPC ..... 343/750, 749, 829, 830, 846
See application file for complete search history.

(56) References Cited

U.S. PATENT DOCUMENTS

2005/0168384 A1* 8/2005 Wang et al. ..... 343/700 MS
2007/0285321 A1* 12/2007 Chung et al. ..... 343/702
2011/0080332 A1* 4/2011 Montgomery et al. ..... 343/843

FOREIGN PATENT DOCUMENTS

CN 101106213 A 1/2008

* cited by examiner

*Primary Examiner* — Kristy A Haupt
(74) *Attorney, Agent, or Firm* — Wei Te Chung; Ming Chieh Chang

(57) ABSTRACT

A multi-frequency antenna (1) includes a grounding portion (1) extending along a transversal direction; a radiating arm (11) extending along a transversal direction and disposed above the grounding portion; a connecting arm (12) connected to the grounding portion and the radiating arm; a capacitor (13) connected to the radiating portion and the connecting arm; and a cable (15) having an inner conductor connected to the connecting arm and an outer conductor connected to the grounding portion.

20 Claims, 3 Drawing Sheets

MULTI-FREQUENCY ANTENNA

BACKGROUND OF THE INVENTION

1. Field of the Invention

The present invention relates generally to an antenna, and more particularly to a multi-frequency antenna for mobile device.

2. Description of Prior Art

With fast development of wireless communication, an antenna plays more and more important role thereof. In order to be installed inside an electronic device, the antenna needs lower profile, comprehensive functional, etc.

As it is known to all, a kind of antenna called PIPA has been widely used in mobile device. And even a double-frequency PIFA also utilized in wireless communication. The double-frequency PIFA includes a first radiating arm, a second radiating arm, a short circuit arm, a grounding portion and a feeding line. The first radiating arm and the second radiating arm are connected to one end of the shirt circuit arm and extend along opposite direction. The other end of the shirt circuit arm is coupled to the grounding portion. The feeding line is connected to a feeding point on the shirt circuit arm. Thus, the antenna may works at two frequencies.

However, the double-frequency antenna is relatively larger and takes up more space inside of the mobile device. In addition, once the antenna is completed, and the frequency is invariable.

SUMMARY OF THE INVENTION

An object of the present invention is to provide a lower profile multi-frequency antenna.

To achieve the aforementioned object, the present invention provides a multi-frequency antenna comprising a grounding portion extending along a transversal direction; a radiating arm extending along a transversal direction and disposed above the grounding portion; a connecting arm connected to the grounding portion and the radiating arm; a capacitor connected to the radiating portion and the connecting arm; and a cable having an inner conductor connected to the connecting arm and an outer conductor connected to the grounding portion.

Additional novel features and advantages of the present invention will become apparent by reference to the following detailed description when taken in conjunction with the accompanying drawings.

DETAILED DESCRIPTION OF THE INVENTION

Reference will now be made in detail to the preferred embodiment of the present invention.

Figure 1:
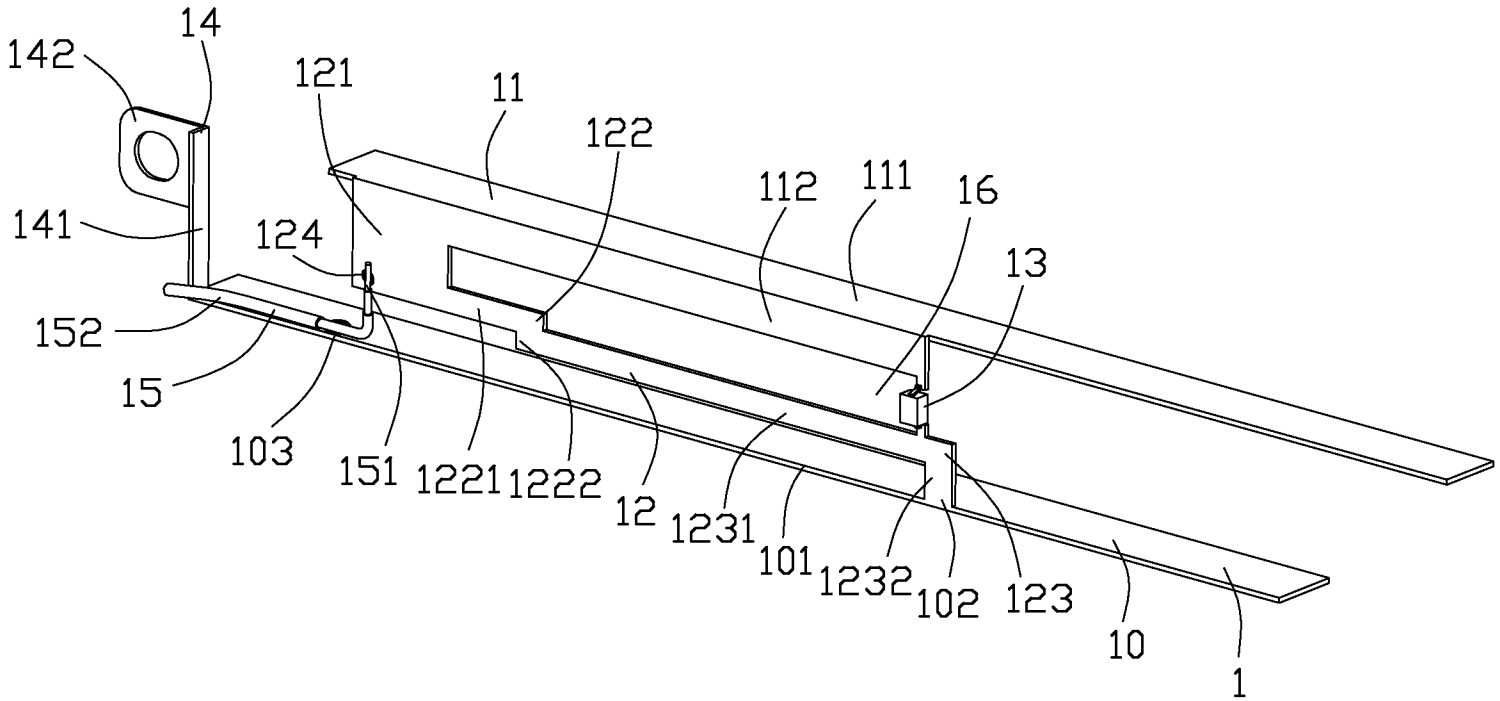
FIG. 1 is a perspective view of a multi-frequency antenna in accordance with the present invention.
Figure 2:
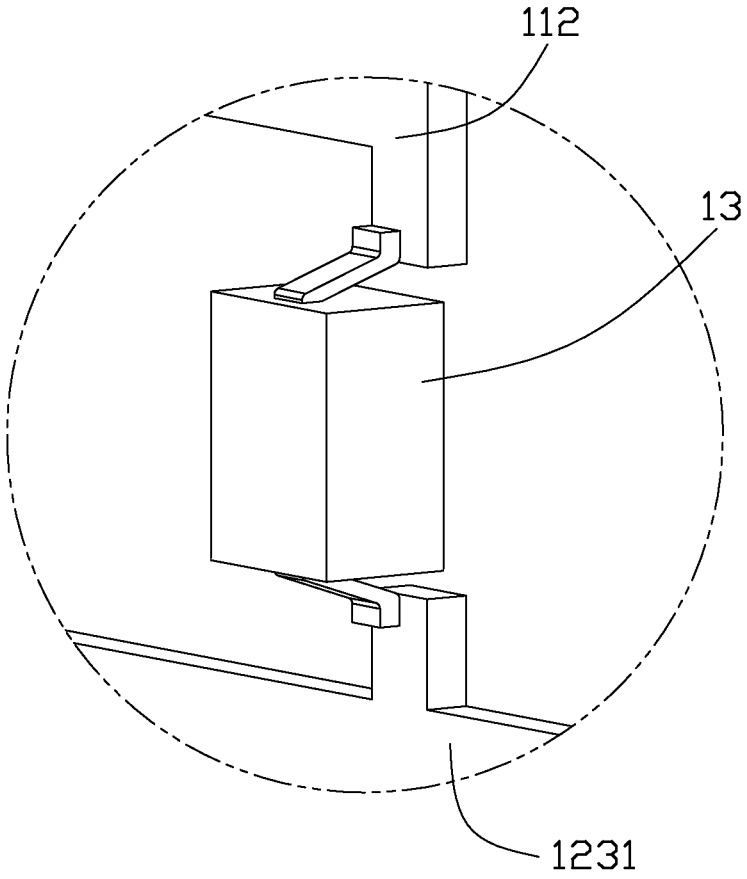
FIG. 2 is an enlarged view of a capacitor mounted to the antenna in FIG. 1.

Referring to FIGS. 1 and 2, a multi-frequency antenna 1 in accordance with the present invention comprises a grounding portion 10, a radiating portion 11 disposed above and spaced apart from the grounding portion 10 and a connecting arm 12 linking the grounding portion 10 and the radiating portion 11.

The multi-frequency antenna 1 further comprises a capacitor 13 mounted on the grounding portion 10 and arranged between the grounding portion 10 and the radiating portion 11. A mounting segment 14 is connected to an end of the grounding portion 10. A cable 15 is electrically connected to the connecting arm 12. The multi-frequency antenna 1 is made of metallic sheet.

The grounding portion 10 is made of a transversal metallic sheet and placed in a first horizontal plane. The grounding portion 10 has a first edge (front edge) 101 and a grounding point 103 located at one lateral side (left side) and a shirt circuit point 102 located at the other lateral side. The connecting arm 12 is projecting upwardly from the shirt circuit point 102. The radiating arm 11 extends upwardly from a top side of the connecting arm 12. The radiating arm 11 includes a first radiating arm 111 disposed above and arranged parallel to the grounding portion 10, and a second radiating arm 112 bending downwardly from a first side (front side) of the first radiating arm 111. The first radiating arm 111 is longer than the second radiating arm 112 and also perpendicular to the second radiation arm 112. Both the first radiating arm 111 and the second radiating arm 112 are made of a rectangular shaped metallic sheet and extend along the horizontal direction.

The connecting arm 12 includes a first connecting arm 121, a second connecting 122 and a third connecting arm 123 connected with each other in sequence. The first connecting arm 121 connects with the second radiating arm 112 and the second connecting arm 122. The third connecting arm 123 has a lower end connecting with the shirt circuit point 102. The second connecting arm 122 connects with the first connecting arm 121 and the third connecting arm 123. Both the second connecting arm 122 and the third connecting arm 123 are L-shaped. There is a feeding point 124 formed at a left lower corner of the first connecting arm 121. The second connecting arm 122 has a first sub-arm 1221 extending along a transversal direction and a second sub-arm 1222 extending downwardly from a right end of the first sub-arm 1221. The third connecting arm 123 has a third sub-arm 1231 extending along a transversal direction and a fourth sub-arm 1232 extending downwardly from a right end of the third sub-arm 1231. A left end of the first sub-arm 1221 connects to a lower portion of the first connecting arm 121. The third sub-arm 1231 connects to a lower portion of the second sub-arm 1222. A lower portion of the fourth sub-arm 1232 connects to the shirt circuit point 102. The first sub-arm 1221 and the third sub-arm 1231 are parallel to the second radiating arm 112. There is a transversal slot 16 formed between the second radiating arm 112, the first connecting arm 121, the second connecting arm 122 and the third connecting arm 123. The transversal slot 16 has different width along the transversal direction. The connecting arm 12 and the second radiating arm 112 are disposed in a same vertical plane.

The capacitor 13 is a variable capacitor and has two legs (not numbered) respectively connect to a right lower portion of the second radiating arm 112 and a top right upper portion of the third connecting arm 123. However, the capacitor 13 may be connected to other positions of the second radiating arm 112 and the third connecting arm 123. In alternative embodiment, the capacitor 13 can be a varactor.

Figure 3:
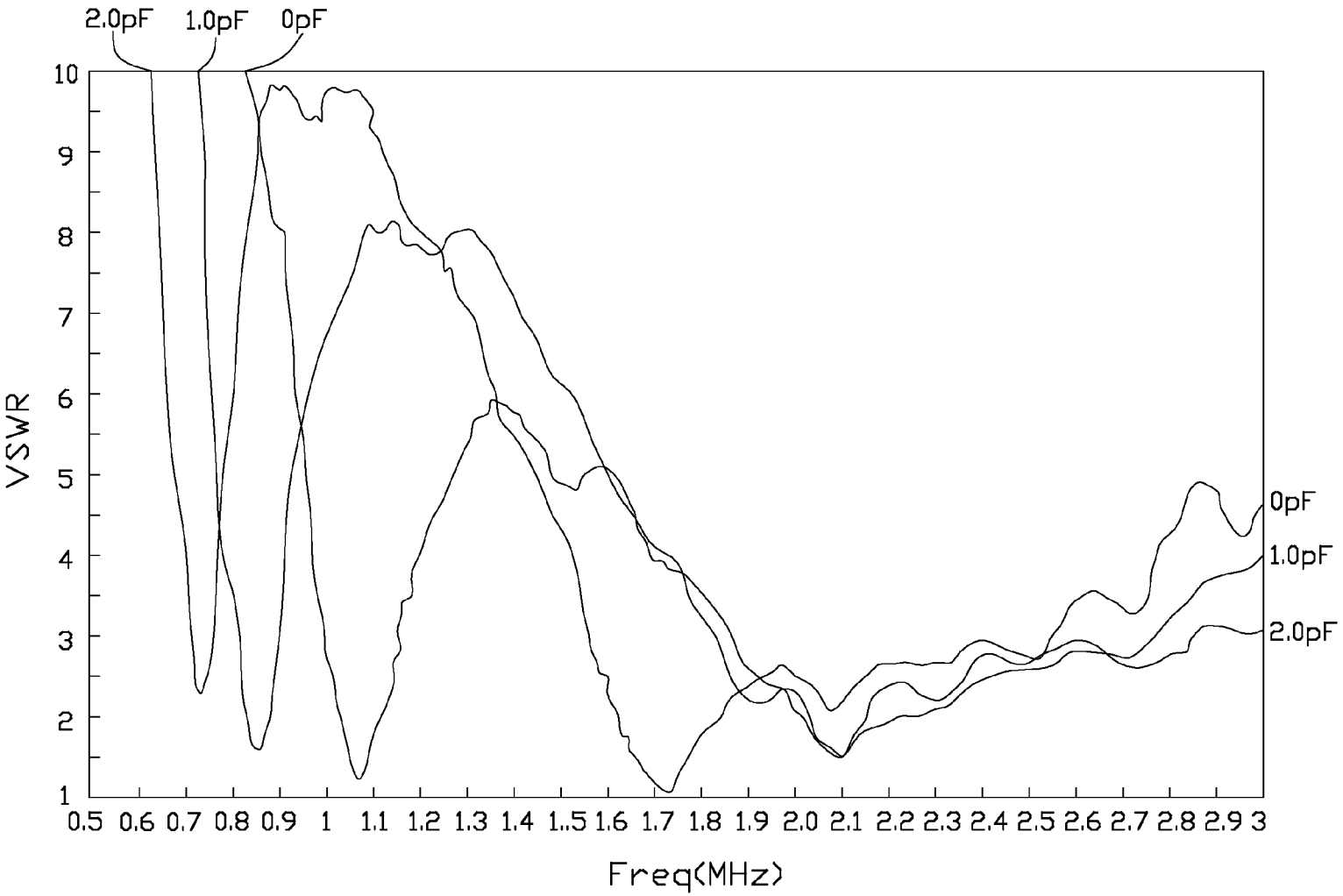
FIG. 3 is a test chart recording for the multi-frequency antenna of FIG. 1, showing Voltage Standing Wave Ratio (VSWR).

Referring to FIG. 3, showing different Voltage Standing Wave Ratio (VSWR), when capacitor 3 is chosen from different value. When the value of the capacitor 3 is 0 pF, the radiating arm 11 operates at a first frequency, and the connecting arm 12 operates at a second frequency. The first frequency is lower than the second frequency. When the value of the capacitor 3 is 1.0 pF, the radiating arm 11 operates at a lower first frequency. When the value of the capacitor 3 is 2 pF, the radiating arm 11 operates at a more lower first frequency, and the connecting arm 12 operates at a lower second frequency. Therefore, the antenna 1 can operates at different frequency without changing dimension thereof Therefore, such design can reduce cost and lower profile of the antenna.

The mounting segment 14 includes a supporting part 141 extending upwardly from a left edge of the grounding portion 10 and a fixing part 142 laterally extending from an upper portion of the supporting part 141. In addition, there is hole (not numbered) defined on the fixing part 142.

The cable 5 is a coaxial cable and has an inner conductor 151 connected to a feeding point 124 on the connecting arm 12 and an outer conductor 152 connected a grounding point 103 of the grounding portion 10.

The antenna 1 can be made from a metallic sheet by stamping or cutting proceeding. Also, the antenna 1 may be etched in or printed on a substrate While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. A multi-frequency antenna, comprising:

a grounding portion extending along a transversal direction;

a radiating arm extending along a transversal direction and disposed above the grounding portion;

a connecting arm connected to the grounding portion and the radiating arm;

a capacitor connected to the radiating arm and the connecting arm; and a cable having an inner conductor connected to the connecting arm and an outer conductor connected to the grounding portion; wherein the connecting arm including a first connecting arm, a second connecting arm and a third connecting arm connect with one another in sequence, the first connecting arm connected to the radiating arm while the third connecting arm connected to the grounding portion.

2. The multi-frequency antenna as claimed in claim 1, wherein there is a slot formed between the connecting arm and the radiating portion, and the capacitor is disposed in the slot.

3. The multi-frequency antenna as claimed in claim 1, wherein the radiating arm includes a first radiating arm disposed above and arranged parallel to the grounding portion.

4. The multi-frequency antenna as claimed in claim 3, wherein the radiating arm further includes a second radiating arm bending downwardly from a first side of the first radiating arm.

5. The multi-frequency antenna as claimed in claim 4, wherein the first radiating arm is longer than the second radiating arm and perpendicular to the second radiation arm.

6. The multi-frequency antenna as claimed in claim 4, wherein the connecting arm and the second radiating arm are disposed in a same vertical plane.

7. The multi-frequency antenna as claimed in claim 1, wherein both the second connecting arm and the third connecting arm are L-shaped.

8. The multi-frequency antenna as claimed in claim 1, wherein the capacitor has two legs respectively connect to the second radiating arm and the third connecting arm.

9. The multi-frequency antenna as claimed in claim 1, wherein the capacitor is a variable capacitor.

10. The multi-frequency antenna as claimed in claim 1, wherein the capacitor is connected to the third connecting arm.

11. A multi-frequency antenna, comprising:

a grounding portion;

a radiating arm extending along a transversal direction and disposed above the grounding portion;

a connecting arm linking the grounding portion and the radiating arm;

a varactor connected to the radiating portion and the connecting arm; and a cable having an inner conductor connected to the connecting arm and an outer conductor connected the grounding portion;

the radiating arm operating at a first frequency, and the connecting arm operating at a second frequency, and the first frequency being lower than the second frequency.

12. The multi-frequency antenna as claimed in claim 11, wherein there is a slot defined between the radiating arm and the connecting arm, and the varactor is located adjacent to the slot.

13. The multi-frequency antenna as claimed in claim 12, wherein the slot extends along a transversal direction and has different width.

14. The multi-frequency antenna as claimed in claim 13, wherein there is a mounting segment connected to the grounding portion, and the mounting segment includes a supporting part extending upwardly from a left edge of the grounding portion and a fixing part laterally extending from an upper portion of the supporting part.

15. A multi-frequency antenna comprising:

a grounding portion spanning in essentially a first lying plane and extending along a lengthwise direction;

a radiating portion including a first part spanning in essentially a second lying plane, and extending along said lengthwise direction;

a connection portion linking between the grounding portion and the radiation portion and essentially spanning in said upstanding plane; wherein the connection portion defines an upper horizontal slot and a lower horizontal slot spaced from each other in a vertical direction perpendicular to said lengthwise direction , under condition that said upper horizontal slot is originally equipped with an upper opening to communicate with an exterior in the lengthwise direction while being sealed by a capacitor or varactor having two ends connected to the radiating portion and the connection portion respectively by two sides of the upper horizontal slot in said vertical direction, and said lower horizontal slot is originally equipped with a lower opening to communicate with the exterior in the lengthwise direction while being sealed by a coaxial cable which has an outer conductor connected to the grounding portion and an inner conductor connected to the connection portion.

16. The multi-frequency antenna as claimed in claim 15, wherein said radiating portion further includes a second part spanning in an upstanding plane, and said capacitor or varactor is connected to said second part.

17. The multi-frequency antenna as claimed in claim 16, wherein both said first lying plane and said second lying plane are horizontal planes, and said upstanding plane is a vertical plane.

18. The multi-frequency antenna as claimed in claim 15, wherein the upper horizontal slot and the lower horizontal slot are directly opposite to each other.

19. The multi-frequency antenna as claimed in claim 15, wherein the connection portion defines a intermediate arm separating the upper horizontal slot and the lower horizontal slot, and said intermediate arm defines a step structure thereof.

20. The multi-frequency antenna as claimed in claim 19, wherein said step structure is closer to the opening of the lower horizontal slot than to the opening of the upper horizontal slot.

* * * * *